US006687484B2

(12) United States Patent
Oikawa

(10) Patent No.: US 6,687,484 B2
(45) Date of Patent: Feb. 3, 2004

(54) SHEET TRANSPORTING APPARATUS AND IMAGE FORMING APPARATUS

(75) Inventor: Atsuteru Oikawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/072,905

(22) Filed: Feb. 12, 2002

(65) Prior Publication Data

US 2002/0109289 A1 Aug. 15, 2002

(30) Foreign Application Priority Data

Feb. 13, 2001 (JP) ..... 2001/036013

(51) Int. Cl.[7] ..... G03G 15/00; B65H 29/70

(52) U.S. Cl. ..... 399/406; 271/188

(58) Field of Search ..... 399/397, 403, 399/405, 406, 407, 408, 410; 271/161, 188, 209; 162/197, 270, 271; 493/459

(56) References Cited

U.S. PATENT DOCUMENTS 4,591,259 A * 5/1986 Kuo et al. ..... 399/406
5,392,106 A * 2/1995 Bigenwald et al. ..... 399/406
5,414,503 A * 5/1995 Siegel et al. ..... 399/406
5,539,511 A * 7/1996 Wenthe, Jr. et al. .... 162/270 X
5,722,030 A * 2/1998 Kato ..... 399/403
5,749,040 A * 5/1998 Muramatsu ..... 399/406
5,848,347 A * 12/1998 Kuo et al. ..... 399/406
5,947,467 A * 9/1999 Billings et al. ..... 271/188
6,246,860 B1 * 6/2001 Ohmichi ..... 399/406

* cited by examiner

*Primary Examiner*—Sandra Brase
(74) *Attorney, Agent, or Firm*—Fitzpatrick, Cella, Harper & Scinto

(57) ABSTRACT

A sheet transporting apparatus and an image forming apparatus, both achieving the prevention of any jam owing to a sheet delivered by an aftertreatment apparatus, transport the sheet, which has straightly been transported or has been reversed and transported in a buffer unit, to a sorter as it is without performing any correcting operation by a correcting device when a group mode is selected, and the sheet transporting means and the image forming apparatus perform the curl correction of the sheet by executing correcting operation of the correcting device to remove the curl of the sheet when a mode other than the group mode is selected.

16 Claims, 15 Drawing Sheets

SHEET TRANSPORTING APPARATUS AND IMAGE FORMING APPARATUS

BACKGROUND OF THE INVENTION

1. Field of the Invention

The present invention relates to a sheet transporting apparatus for guiding a sheet to an aftertreatment apparatus and having a function of correcting a curl of the sheet, and to an image forming apparatus provided with the sheet transporting apparatus.

2. Description of Related Art

An image forming apparatus (such as a copying machine, a printer and the like) employing an electrophotographic process transfers a toner image formed on a photosensitive drum (or an electrophotographic photosensitive member) being an image bearing member to a sheet, and the image forming apparatus passes the sheet, on which the toner image has been transferred, through a fixing device. The image forming apparatus thereby fixes the toner image on the surface of the sheet to be a permanent image. Incidentally, silicone oil is generally applied on the surface of the sheet that is passing through the fixing device in order to prevent the toner of the toner image and the sheet from adhering to a fixing roller.

Moreover, an image forming apparatus equipped with a sheet aftertreatment apparatus for sorting sheets, on which images have been fixed, with a sorter, a finisher or the like is known. Besides, an image forming apparatus equipped with a sheet transporting apparatus (hereinafter referred to as a "buffer unit") for transporting sheets delivered from the main body of the image forming apparatus to the sheet aftertreatment apparatus is known.

An image forming apparatus employing the electrophotographic process has a full color mode for superimposing four color toners on a sheet as in a full color machine, a monochromatic mode for forming an image only by one color toner, and a two-color and a three-color modes for superimposing two and three color toners on a sheet respectively.

Generally speaking, when a sheet bearing a toner image on one side thereof has been passed through pressure and heating rollers for the fixation of the toner image, the sheet curls to bend to the side of the image surface thereof on which the toner image is borne.

However, when such a curled sheet, which has passed through the fixing device, is contained in a sheet aftertreatment apparatus such as the sorter, the finisher or the like, a delivery tray or the like, a faulty sheet transport such as a sheet jam may often occur, and there is a possibility that the functions of the sheet aftertreatment apparatus such as the sorter, the finisher or the like are not fully performed.

Accordingly, it is generally performed to dispose the buffer unit having a function of correcting the curl formed in a sheet between (the fixing device of) the main body of the image forming apparatus and the sheet aftertreatment apparatus such as the sorter, the finisher or the like or the delivery tray.

Incidentally, the buffer unit may be integrally provided to an image forming apparatus to be one body. Alternatively, the buffer unit may be discretely provided between the main body of the image forming apparatus and the sheet aftertreatment apparatus as a separate body.

Next, FIG. 14 and FIG. 15 are referred while a related art sheet transporting apparatus and a related art image forming apparatus are described more minutely. Incidentally, for the sake of the convenience of descriptions, the same component as those disclosed in the drawings to be referred in the descriptions of a sheet transporting apparatus and image forming apparatuses according to the embodiments of the present invention that will be described later are designated by the same reference numerals or signs, and the descriptions about the same components are suitably omitted.

As shown in FIG. 14, the related art image forming apparatus includes a main body 400 thereof for forming an image on a sheet, a sheet aftertreatment apparatus (hereinafter referred to as a "sorter") 200 having a function of sorting sheets on which images have already been formed, and a sheet transporting apparatus (hereinafter referred to as a "buffer unit") 100 disposed between the main body 400 and the sorter 200.

Incidentally, the shown image forming apparatus has a configuration in which the main body 400, the buffer unit 100 and the sorter 200 are separately disposed. But an image forming apparatus may be provided with these components formed in one integral body.

The buffer unit 100 has a function of switching the transportation state of a sheet fed from the main body 400 between the transportation of the sheet without the reversing of the surface thereof and the transportation of the sheet with the reversing of the surface thereof.

Moreover, the buffer unit 100 is provided with correcting means 104 and 110 for correcting the curl formed in a transported sheet.

The correcting means 104 corrects an up-curl, or upward bending of a sheet, and the correcting means 110 corrects a down-curl, or downward bending of a sheet.

And, because a sheet ordinarily curls to bend toward one side of the two-side copied sheet in which the image density of a formed image is higher than that on the other side of the sheet, either of the correcting means 104 and 110 is operated on the basis of the information concerning the image densities.

Moreover, the sorter 200 is equipped with a non-sort bin B0 at the uppermost position and a plurality of sort bins B1, B2 . . . and B20 at lower positions. The sorter 200 has a function of delivering transported sheets while performing the sorting of the sheets such as the collating and the grouping of the sheets.

As described above, conventionally, when the correcting means 104 and 110 as curl correcting means are provided in the buffer unit 100, the correcting means 104 and 110 are controlled on the basis of the difference between the image densities of images borne on both sides of a sheet S to be fed into a sheet aftertreatment apparatus such as the sorter 200 regardless of the processing method of the sorter 200.

However, such a curl correction method being performed on the basis of the difference between the image densities on both sides has a problem of the occurrence of a paper jam (hereinafter simply referred to as a "jam") owing to the waving of sheets S (see, for example, the sheets S stacked on the sort bin B7 shown in FIG. 15) when the sheets S are delivered on the sort bins B1–B20 of the sorter 200 in a group mode or a stack mode.

The problem is described more minutely in the following.

In the group mode or in the stack mode, the sheets S are delivered on the sort bins B1–B20.

Hereupon, the curl correction of the sheets S (the up-curl correction of the sheets S by the correcting means 104 in the example in FIG. 15) is performed in the buffer unit 100, and the sheets S are transported through a sort path 205 and delivered by delivery rollers 206.

Immediately after the correction of a sheet S, the sheet S is slightly curled reversely to the curl in the sheet before the correction. That is, the sheet S in the example shown in FIG. 15 is slightly down-curled because the sheet S has suffered from the up-curl correction.

Because such sheets S are continuously delivered to the sort bin, a successive sheet S is delivered before the curl (or the up-curl) of a previous sheet S, which has been previously delivered, owing to the toner of an image on the sheet S has grown up. Consequently, the down-curled sheets S continue to be stacked in the sort bin. Then, the height of the stacked delivered sheets S becomes high. Consequently, as shown in FIG. 15, a part of the sheets S stacked on the sort bin B7 is brought into contact with the lower surface of the sort bin B6 positioned immediately above the sort bin B7. Thereby, there is the case where the contact prevents the delivery of a sheet S to be delivered next onto the sort bin B7 to cause a sheet jam.

Moreover, when the sheets S are continuously delivered on the stacked sheets S having still maintained curls formed by the curl correcting means even if the sheets S are delivered on a tray having a sufficient space above the tray like an ordinary delivery tray, a sort tray or the like other than the sort bins, there is a case where a sheet jam may occur due to the interference between the stacked sheets S on the tray and a sheet S that is being delivered.

SUMMARY OF THE INVENTION

The present invention was made for resolving the problems of the aforesaid related art. An object of the present invention is to provide a sheet transporting apparatus and an image forming apparatus, both being capable of preventing the occurrence of a sheet jam due to a sheet delivered in an aftertreatment apparatus.

For attaining the object, a sheet transporting apparatus of the present invention comprises: a transporting path for guiding sheets to an aftertreatment apparatus having a function of sorting and delivering the sheets to a plurality of bins; and correcting means for correcting a curl formed in a sheet transported through the transporting path, wherein, when the aftertreatment apparatus continuously delivers the sheets to sort bins other than a non-sort bin at an uppermost position among the plurality of bins, the correcting means does not perform a correcting operation, or the correcting means performs the correcting operation while lowering a degree of correction than that at a time of delivering the sheets to the non-sort bin.

Moreover, a sheet transporting apparatus of the present invention may comprise: a transporting path for guiding sheets to an aftertreatment apparatus having a function of sorting and delivering the sheets to a plurality of bins; and correcting means for correcting a curl formed in a sheet transported through the transporting path, wherein, when a group mode for delivering the sheets continuously to a predetermined sort bin other than a non-sort bin at an uppermost position among the plurality of bins is selected, the correcting means does not perform a correcting operation, or the correcting means performs the correcting operation while lowering a degree of correction than that at a time of delivering the sheets to the non-sort bin.

Moreover, a sheet transporting apparatus of the present invention may comprise: a transporting path for guiding sheets to an aftertreatment apparatus having a function of sorting and delivering the sheets to a plurality of bins; and correcting means for correcting a curl formed in a sheet transported through the transporting path, wherein, when a stack mode for delivering the sheets to sort bins other than a non-sort bin at an uppermost position among the plurality of bins if a number of the sheets to be delivered exceeds a number of sheets stackable on the non-sort bin is selected, the correcting means does not perform a correcting operation, or the correcting means performs the correcting operation while lowering a degree of correction than that at a time of delivering the sheets to the non-sort bin.

It is preferable that a sheet transporting apparatus further comprises surface reverse means for reversing a front and back sides of a sheet transported from an upstream side to guide the reversed sheet to the aftertreatment apparatus.

Moreover, an image forming apparatus of the preset invention may comprise: image forming means for forming an image on a transported sheet; a sheet transporting apparatus according to any one of the aforesaid aspects of the invention for transporting the sheet on which the image has been formed by the image forming means to a further downstream side; and an aftertreatment apparatus having a function of sorting and delivering the sheets transported by the sheet transporting apparatus to a plurality of bins.

It is preferable that an image forming apparatus comprises four image forming means for forming images having different colors from each other, the four image forming means being arranged in tandem, to enable formation of a full color image.

It is preferable that, when a number of sheets stacked on a sort bin other than a non-sort bin at an uppermost position among a plurality of bins installed in the aftertreatment apparatus reaches a maximum stackable number of sheets, or when a delivery of the sheets ceased regardless of the number of the stacked sheets, the stacked sheets on the sort bin are sandwiched, or clenched between the sort bin and a sort bin immediately above the sort bin.

DESCRIPTION OF THE PREFERRED EMBODIMENTS

Hereinafter, the accompanying drawings are referred while the preferred embodiments of the present invention are exemplarily described in detail. Incidentally, the sizes, the materials, the shapes, the relative dispositions and the like of the components mentioned in the embodiments do not mean restricting the scope of the present invention only to the exemplified ones unless a specifying intention is particularly mentioned.

Incidentally, a full color copying machine is described as an example of an image forming apparatus in the following descriptions, but the present invention is not naturally limited to the full color copying machine. It is needless to say that the present invention can be applied to a full color printer, a monochrome copying machine, a monochrome printer, and the like.

First Embodiment

The flow of the operation of the image forming apparatus will be described with reference to the flowchart shown in FIG. 1 and the control block diagram shown in FIG. 13. At the same time, FIG. 3 and FIG. 14 are referred while a sheet transporting apparatus and the image forming apparatus according to a first embodiment of the present invention are described.

Figure 1:
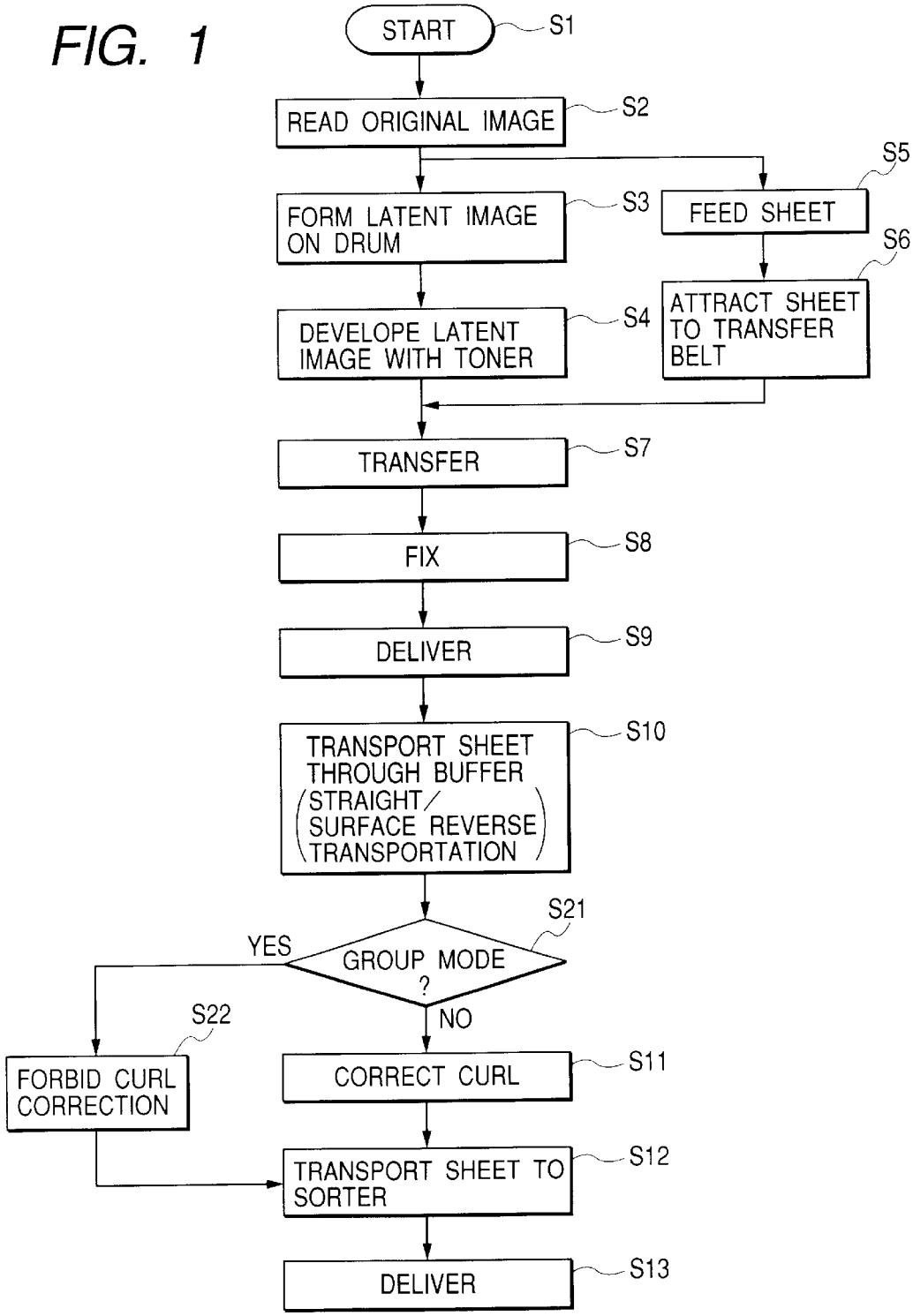
FIG. 1 is a flowchart showing a flow of the operation of an image forming apparatus according to a first embodiment of the present invention.
Figure 3:
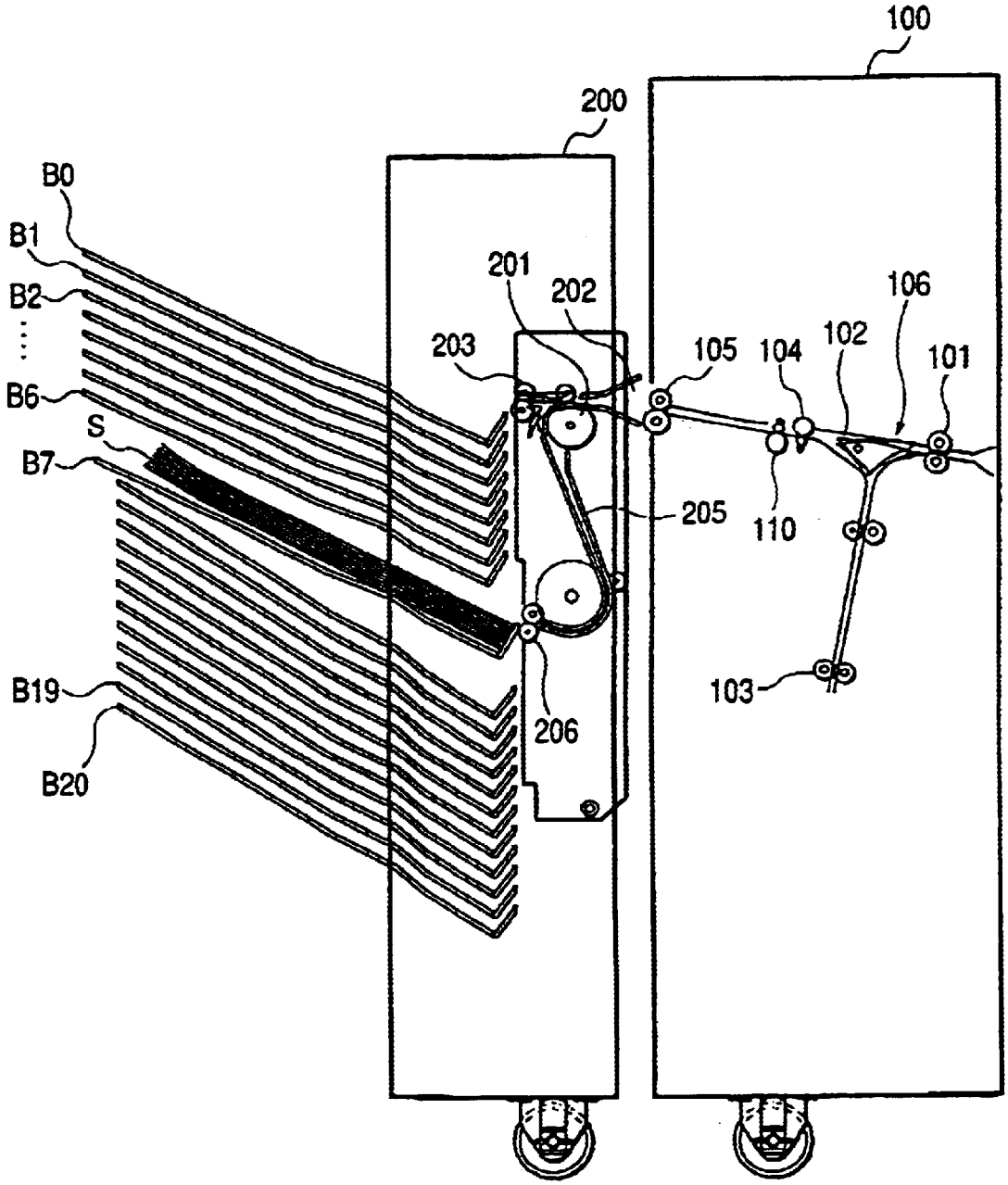
FIG. 3 is a mimetic cross section of a sheet transporting apparatus and an aftertreatment apparatus according to the embodiment of the present invention.

FIG. 1 is the flowchart showing the flow of the operation of the image forming apparatus according to the first embodiment of the present invention, and FIG. 3 is a mimetic cross section of the sheet transporting apparatus and the aftertreatment apparatus according to the first embodiment. Besides, FIG. 14 is a mimetic cross section of the image forming apparatus.

An original (not shown) is placed on an automatic original transporting apparatus DF, and a user depresses a start button (not shown) (Step S1).

Then, a sheet S is fed from a cassette 1*a* or 1*b* (Step S5). The fed sheet S waits at registration rollers 2 for adjusting timing to an image forming portion. While the sheet S is waiting, the original is transported on an original placement stand 3. Then, an optical system 4 scans the original on the original placement stand 3 to read the original with a charge coupled device (CCD). The CCD converts image information of the original to an electric signal (Step S2).

Hereupon, the image information (or electric signal) is decomposed to the components of a yellow image (Y), a magenta image (M), a cyan image (C) and a black image (Bk).

An image signal being the electric signal converted from the image information is transmitted to a laser beam emitting apparatus (not shown) to be utilized for the control of the emission of the laser beam. Then, the laser beam modulated according to the image signal reflected by a polygon mirror 16, and the reflected laser beam irradiates photosensitive drums 5Y, 5M, 5C and 5Bk in an image recording portion to scan them by a mirror unit 11. Thus, the laser beam forms a latent image on each of the photosensitive drums 5Y, 5M, 5C and 5Bk (Step S3).

Incidentally, each of the photosensitive drums 5Y, 5M, 5C and 5Bk clockwise rotates in FIG. 14. Primary chargers 6Y, 6M, 6C and 6Bk uniformly charge the surfaces of the photosensitive drums 5Y, 5M, 5C and 5Bk, respectively. After the charging, the latent images are formed on the photosensitive drums 5Y, 5M, 5C and 5Bk.

The latent images formed on the photosensitive drums 5Y, 5M, 5C and 5Bk are respectively visualized by developing devices 17Y, 17M, 17C and 17Bk as toner images corresponding to each color (Step S4).

On the other hand, the sheet S waiting at the registration rollers 2 is transported while being electrostatically attracted by a transfer belt 9 (Step S6) after the timing of the sheet with the image signal has been adjusted. Then, each color toner image on each of the photosensitive drums 5Y, 5M, 5C and 5Bk is sequentially transferred on the sheet S by being superimposed on top of each other by each of the transfer charger 7Y, 7M, 7C and 7Bk, respectively. Thereby, a full color image formed by the use of a black toner, a yellow toner, a magenta toner and a cyan toner is formed on the sheet S (Step S7).

Incidentally, the toner that has not been transferred to the sheet S and is remaining on each of the photosensitive drums 5Y, 5M, 5C and 5Bk is cleaned by cleaning devices 8Y, 8M, 8C and 8Bk, respectively.

The sheet S, on which a developed image (or a toner image) has been transferred, is transported to a fixing device 10 after the transfer of the image. The toner image on the sheet S is fused and fixed to the surface of the sheet S by the fixing device 10 (Step S8). And then, the sheet S is transported by delivery rollers 31 to the buffer unit 100, which is connected with the main body 400 of the image forming apparatus on the outside thereof and is an embodiment of the present invention (Step S9).

After being transported in the inside of the buffer unit 100, the sheet S is further transported to the sorter 200 as an aftertreatment apparatus for performing the processing such as collating and grouping, and then the image forming process is completed.

The sorter 200 includes a carrying-in portion 202 for carrying in the sheet S delivered from the buffer unit 100, and inlet rollers 201 for drawing in the carried-in sheet S.

The sorter 200 delivers the sheets S on the non-sort bin B0 at the uppermost position with delivery rollers 203 in case of not sorting or not grouping the sheets S. The sorter 200 sorts and delivers the sheets S on the sort bins B1–B20 with delivery rollers 206 after transporting the sheet S through a sort path 205 in case of sorting the sheets S.

The sorter 200 includes a sort mode, a group mode and a stack mode as its main sort functions.

In the sort mode, the sorter 200 delivers the sheets S one by one on the sort bins B1, B2 . . . B19, B20 in the order. After that, the sorter 200 delivers the sheets S one by one on the sort bins B20, B19 . . . B2, B1 in the order. The sorter 200 collates the sheets S by repeating such reciprocating operations. That is, the sorter 200 intermittently delivers the sheet S to one sort bin.

On the other hand, in the group mode and the stack mode, the sorter 200 continuously delivers the sheets S to one sort bin among the sort bins B1, B2 . . . B19, B20 as many as the sort bin can stack the sheets S.

Incidentally, the group mode is a mode for delivering the sheets S to a predetermined sort bin, and the stack mode is a mode for stacking the sheets S on a sort bin automatically when the number of sheets to be continuously delivered which is preselected at the time of the start of copying, exceeds the regulated stackable number of sheets of the non-sort bin.

Moreover, the digital color copying machine is also used as a printer of a system in addition to being solely used as a copying machine. The copying machine has a face-down delivering function for collating the order of the pages of the sheets S for the use of the machine as the printer.

Figure 7C:
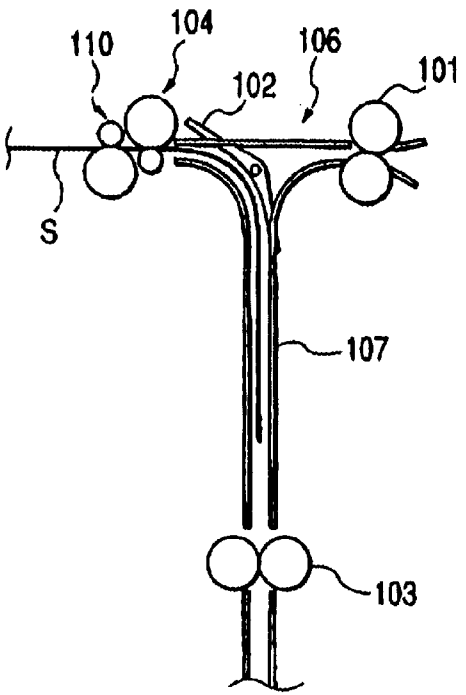
FIGS. 7A, 7B and 7C are mimetic diagrams showing a sheet transporting path in the sheet transporting apparatus according to the embodiment of the present invention.
Figure 7B:
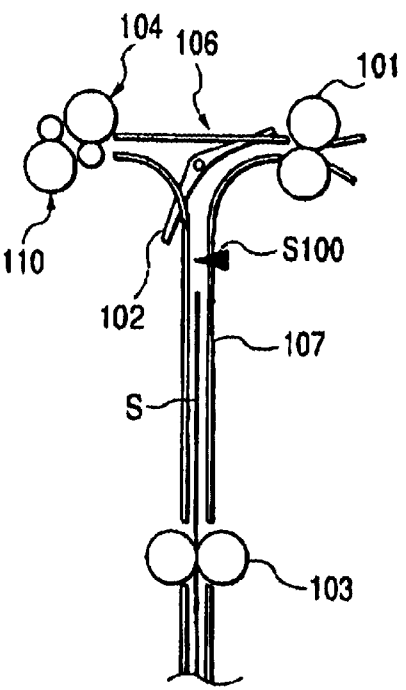
Figure 7A:
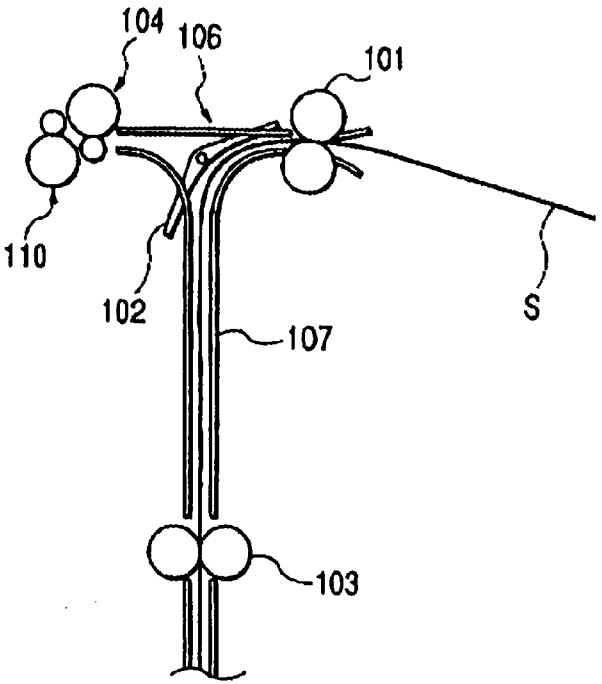

FIGS. 7A, 7B and 7C are referred while a transportation path in the buffer unit 100 is described. FIGS. 7A, 7B and 7C are mimetic diagrams showing the sheet transporting path in the sheet transporting apparatus (or the buffer unit 100) according to the embodiment of the present invention.

In FIGS. 7A to 7C, a branch portion 106 equipped with a branch member (or surface reverse means) 102 is disposed on the downstream side of transportation rollers 101 on a sheet transporting path 109 (see FIG. 14). The branch member 102 is made to be able to switch its state between the state of guiding the sheet S to delivery rollers 105 and the state of reversing the sheet S to a surface reverse transporting path 107 by a surface reverse solenoid (not shown).

In case of a face-down delivery of the sheet S, the branch member 102 forms a path to the surface reverse transporting path 107 as shown in FIG. 7A.

Surface reverse rollers 103 rotatable in a forward direction and a reverse direction are disposed at the surface reverse transporting path 107. Quantities and directions of rotations of the surface reverse rollers 103 are controlled by a motor for surface-reversing (not shown) being a step motor.

In case of the face-down delivery, the sheet S passes the branch member 102 in the branch portion 106 in the state shown in FIG. 7A to be guided to the inside of the surface reverse transporting path 107. Then, after the trailing edge of the sheet S has passed the branch member 102 as shown in FIG. 7B, the sheet S temporarily stops. Incidentally, the passage of the sheet S is detected by a sensor S100.

After that, the branch member 102 is controlled to be switched to the delivery rollers 105 side (see FIG. 7C). Moreover, the surface reverse rollers 103 reversely rotate to reverse and transport the sheet S. The sheet S to be transported is transported to the delivery rollers 105 side (see FIG. 3) through the branch member 102 as shown in FIG. 7C. Then, the sheet S is delivered to the outside of the buffer unit 100 by the delivery rollers 105.

Through the operation process mentioned above, the sheet S can be transported while the front side of the sheet S is turned over to the back side thereof. By the execution of the face-down delivery of the sheets S in such a way, the delivered sheets S are collated to be ascending order of the numbers of pages such as 1, 2, . . . from the lowermost sheet with their image surfaces facing downward. As a result, even if the main body 400 of the image forming apparatus is used as an outputting device (or a printer) of external equipment, the occurrence of a page fault of the delivered sheets can previously be prevented.

Moreover, the buffer unit 100 has a curl correction function of the sheet S as another important role thereof.

Figure 8A:
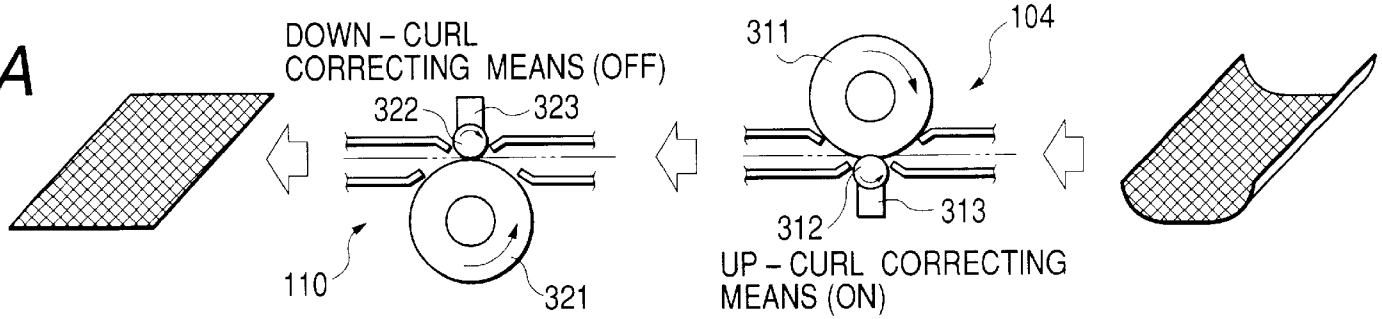
FIGS. 8A and 8B are explanatory drawings of the mechanism of curl correction of a sheet.
Figure 8B:
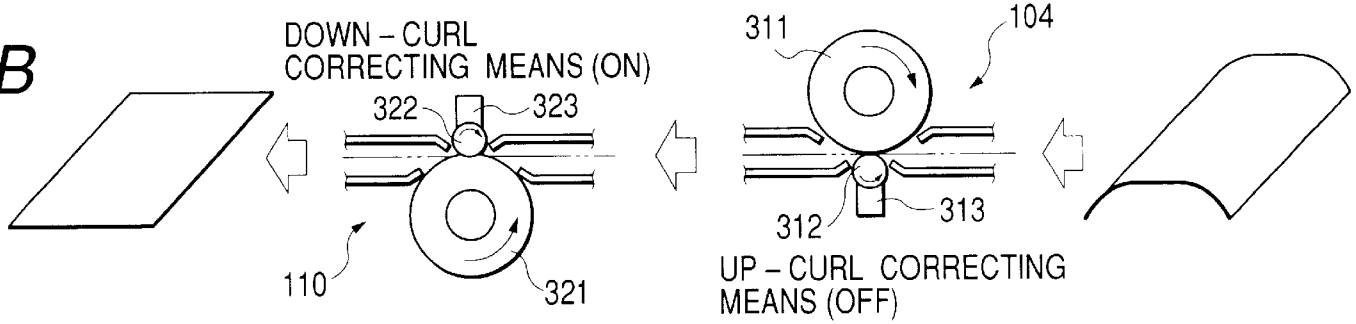

Hereupon, FIGS. 8A and 8B are referred while the correcting means 104 and 110 serving as the curl correcting means of the buffer unit 100 are described. FIGS. 8A and 8B are explanatory drawings of the mechanism of curl correction.

The correcting means 104 and 110 are respectively composed of sponge rollers 311 and 321 including a metal shaft with a wounded material such as polyurethane rubber on the outer surface of the metal shaft severally, metal rollers 312 and 322 disposed opposite to the sponge rollers 311 and 321 respectively, and backup members 313 and 323 supporting the metal rollers 312 and 322 respectively.

When the sheet S passes the correcting means 104 and 110, the sponge rollers 311 and 321 are pressed to and inroaded onto the metal rollers 312 and 322, respectively, by cam controls. Thereby, a nip is formed at each of the correcting means 104 and 110 for correcting the curl of the sheet S by the passing of the sheet S through the nips.

Moreover, by eccentric cams (not shown) or the like, the curl correction ability of the correcting means 104 and 110 can be adjusted at several steps of the degrees of the quantities of the respective inroad of the sponge rollers 311 and 312 onto the metal rollers 312 and 322.

Figure 13:
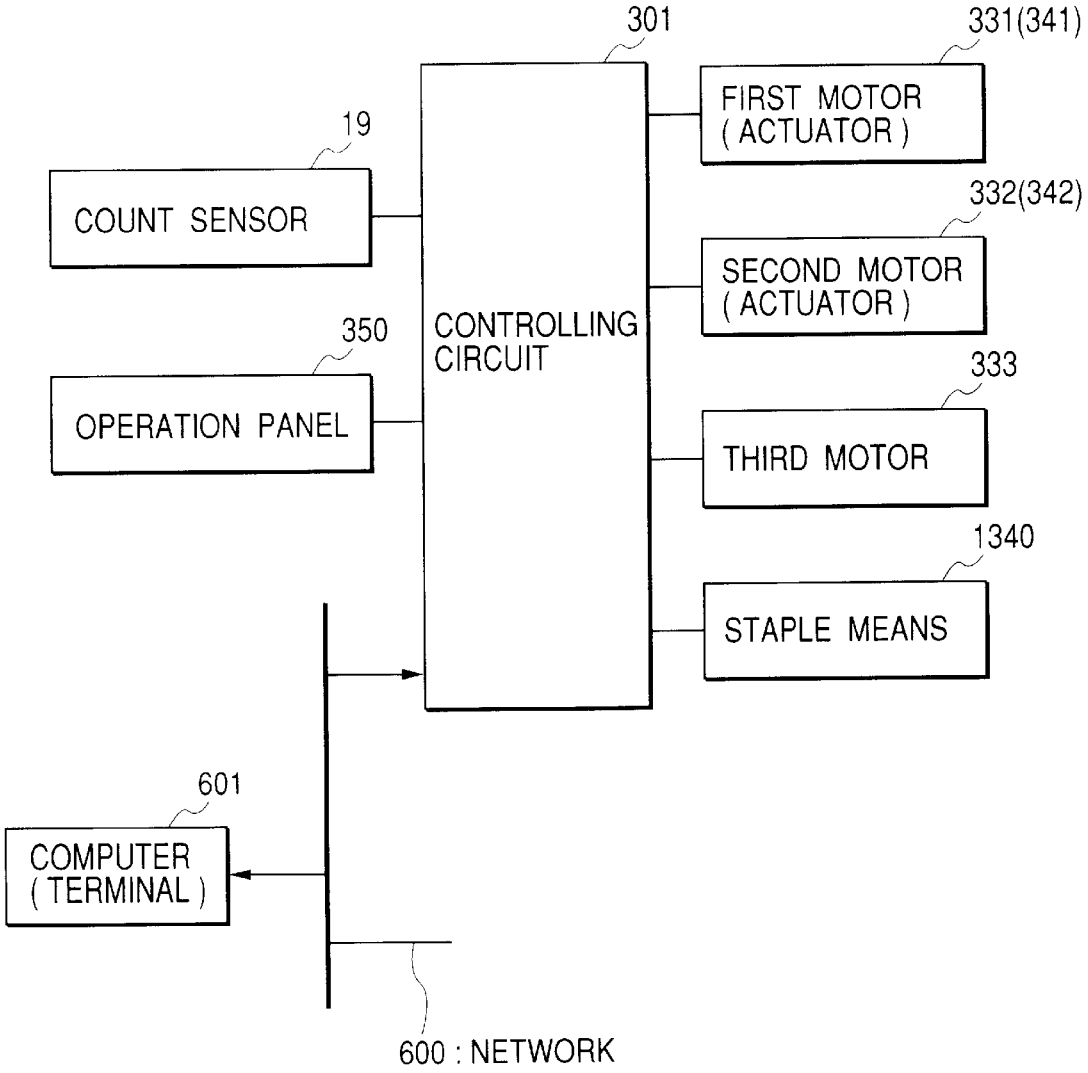
FIG. 13 is a control block diagram of the first to the fifth embodiments of the present invention.
Figure 14:
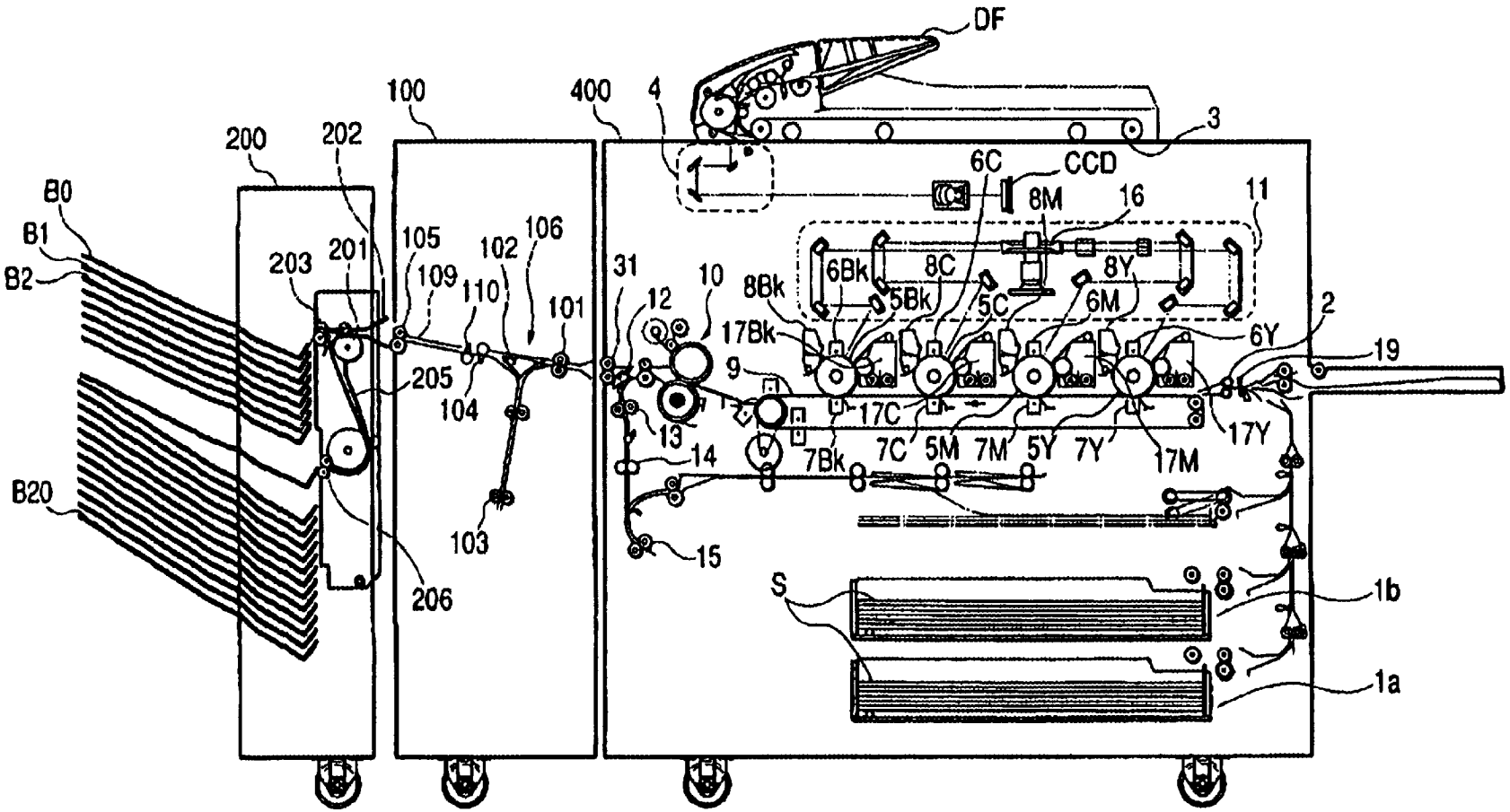
FIG. 14 PRIOR ART
FIG. 14 is a mimetic cross section of a conventional image forming apparatus and the image forming apparatuses according to the embodiment of the present invention.
Figure 15:
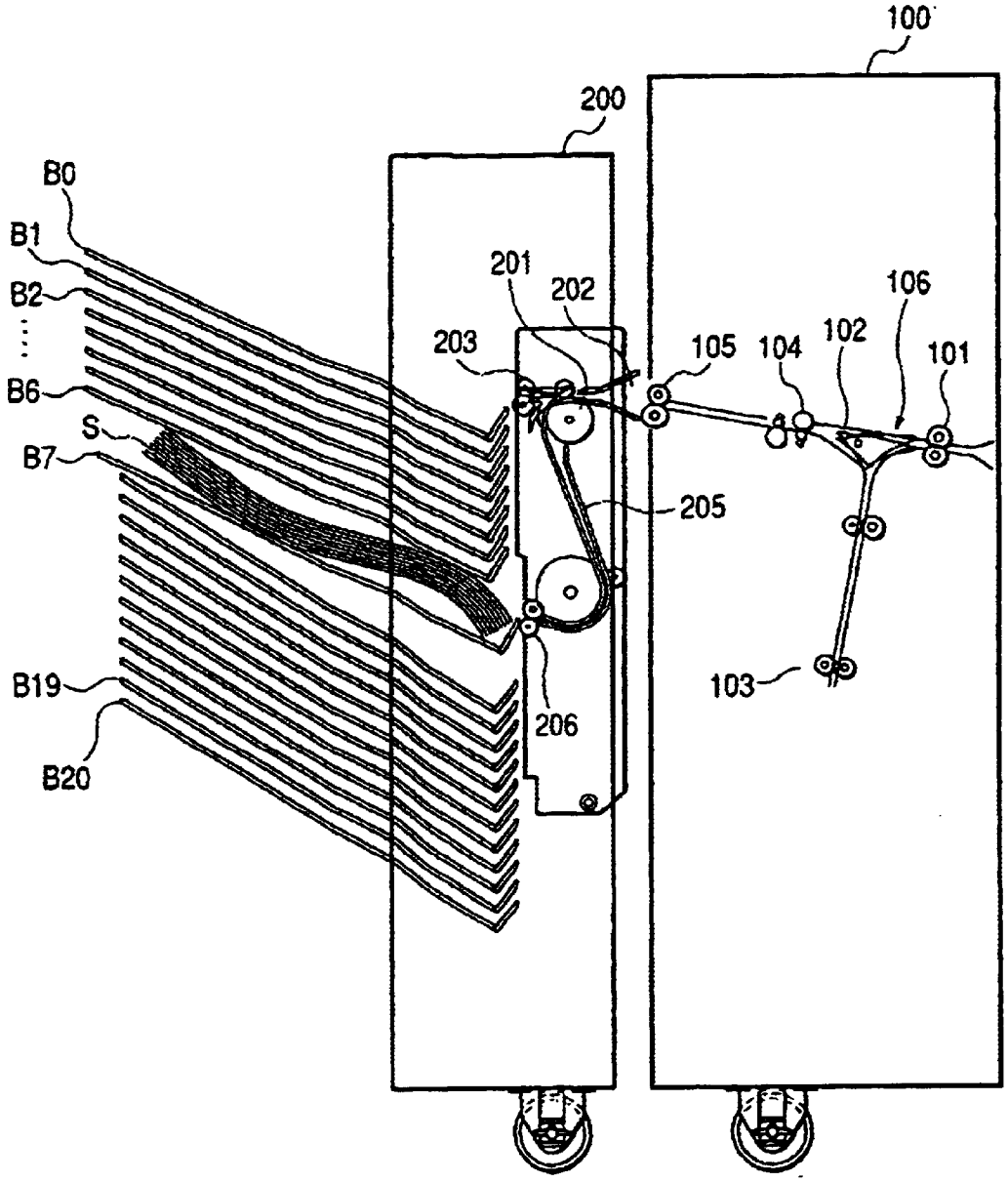
FIG. 15 PRIOR ART
FIG. 15 is an explanatory drawing for illustrating a problem of a sheet transporting apparatus according to related art.

FIG. 13 is a control block diagram of the control of the curl correcting ability of the curl correcting means 104 and 110. A first motor 331 and a second motor 332 respectively rotate the eccentric cams for moving the sponge rollers 311 and 321. When a controlling circuit (controlling means) 301 controls the first motor 331 to rotate it, a first eccentric cam (not shown) rotates to bring the rotation shaft of the sponge roller 311 close to or far from the metal roller 312, and thereby the curl correction ability of the correcting means 104 is adjusted. Then, when the rotation shaft of the sponge roller 311 is brought to the farthest position from the metal roller 312, the curl correction function does not work.

Similarly, when the second motor 332 rotates a second eccentric cam, the rotation shaft of the sponge roller 321 moves to adjust the curl correction ability of the correcting means 110 or to disable the curl correction ability thereof.

Moreover, the sponge rollers 311 and 321 may be moved by actuators 341 and 342 such as solenoids instead of the motors 331 and 332.

In FIG. 13, the third motor 333 is driving means for moving the positions of the trays of stacking means such as a processing tray and the sorter.

A reference numeral 350 designates an operation panel being inputting means with which an operator inputs processing instructions designating a number of copying sheets, a execution mode such as the sort mode, the group mode, the stack mode and a staple mode, and the like. The controlling circuit 301 controls the first motor 331, the second motor 332, the third motor 333, staple means 1340 and the like according to the number of copying sheets and a mode that are inputted with the operation panel 350.

Moreover, the processing instructions and image information for forming an image may be inputted from a computer terminal 601 through a network 600 such as a communication cable. The computer terminal 601 and the network 600 are also one kind of the inputting means.

FIG. 8A illustrates the control in the case where the image density on the front side of a sheet S is higher than that on the back side thereof when the sheet S is transported to the correcting means 104 and 110. In this case, the sponge roller 311 of the correcting means 104 for correcting the up-curl of the sheet S is inroaded and pressed to the nipped sheet S, but the sheet is transported without operating the correcting means 110 for correcting the down-curl of the sheet S.

Thereby, the up-curl formed in the sheet S can be corrected.

On the other hand, FIG. 8B illustrates the control in the case where the image density on the back side of a sheet S is higher than that on the front side thereof when the sheet S is transported to the correcting means 104 and 110. In this case, the sponge roller 321 of the correcting means 110 for correcting the down-curl of the sheet S is inroaded and pressed to the nipped sheet S, but the sheet is transported without operating the correcting means 104 for correcting the up-curl of the sheet S.

Thereby, the down-curl formed in the sheet S can be corrected.

As described above, in case of a straight delivery when the image density on the front side of a sheet S to be delivered is higher than that on the back side thereof regardless of whether the image formation of the sheet S is one-side image formation or two-side image formation, the correcting means 104 for correcting the up-curl of the sheet S is used for the correction of the curl of the sheet S. And in case of a reverse delivery, the correcting means 110 for correcting the down-curl of the sheet S is used for the correction of the curl of the sheet S.

Conversely, in case of a straight delivery when the image density on the back side of a sheet S to be delivered from the main body 400 of the image forming apparatus is higher than that on the front side thereof, the correcting means 110 for correcting the down-curl of the sheet S is used for the correction of the curl of the sheet S. And in case of a reverse delivery, the correcting means 104 for correcting the up-curl of the sheet S is used for the correction of the curl of the sheet S.

Consequently, there is no chance that the correcting means 104 for correcting the up-curl and the correcting means 110 for correcting the down-curl simultaneously operate.

After the curl of the sheet S has been corrected in the way mentioned above, the delivery rollers 105 transport the sheet S to the sorter 200.

Next, the operation control of the buffer unit 100, which is a feature of the present invention, is described more minutely.

When a group mode is selected (or in the case where a result of the judgment at Step S21 is a YES), the controlling means 301 controls the first motor 331 and the second motor 332 not to perform the correcting operation of the correcting means 104 and 110 (Step S22) with respect to the sheet S transported by the straight transportation or the reverse transportation (Step S10) in the buffer unit 100. Consequently, the sheet S is transported to the sorter 200 as it is (Step S12), and is delivered (Step S13).

On the other hand, in case of a mode other than the group mode (or in the case where a result of the judgment at Step S21 is a NO), either of the correcting means 104 and 110 performs its correction operation to correct the curl of the sheet S (Step S11). Consequently, the curl of the sheet S is corrected.

Thus, in the case where the sheets S are continuously delivered on any one of the sort bins B1, B2 . . . B19, B20 that is predetermined in the group mode, the correcting operation is not performed. Consequently, the curls are not formed in the sheets S. Furthermore, the sheets S are continuously delivered on the predetermined sort bin before the growth of the curls, which are to be caused by toner, of the sheets S. Consequently, sheet jams owing to the curls of the sheets S can be prevented.

Hence, the state of the sheets S that are to be continuously stacked on a sort bin can be kept in a good state.

As shown in FIG. 3, the stack alignment of the sheets S on the sort bins B1–B20 (the sort bin B7 in the example shown in FIG. 3) of the sorter 200 in the grouping process can be improved without any occurrence of jams of the sheets S by the execution of the control mentioned above.

Moreover, when the number of sheets S delivered to be stacked on a sort bin among the sort bins B1–B20 reaches the maximum number of stackable sheets on the sort bin, or when the supply of the sheets S ceased regardless of the number of the stacked sheets S, the space between the stacked sort bin and a sort bin placed immediately above the stacked sort bin is closed (or the stacked sheets S are sandwiched, or clenched between the upper and the lower sort bins). Thereby the growth of the curl of the uppermost sheet S among the sheets S stacked on the sort bin can be prevented, and better stackability can be kept.

Second Embodiment

Figure 2:
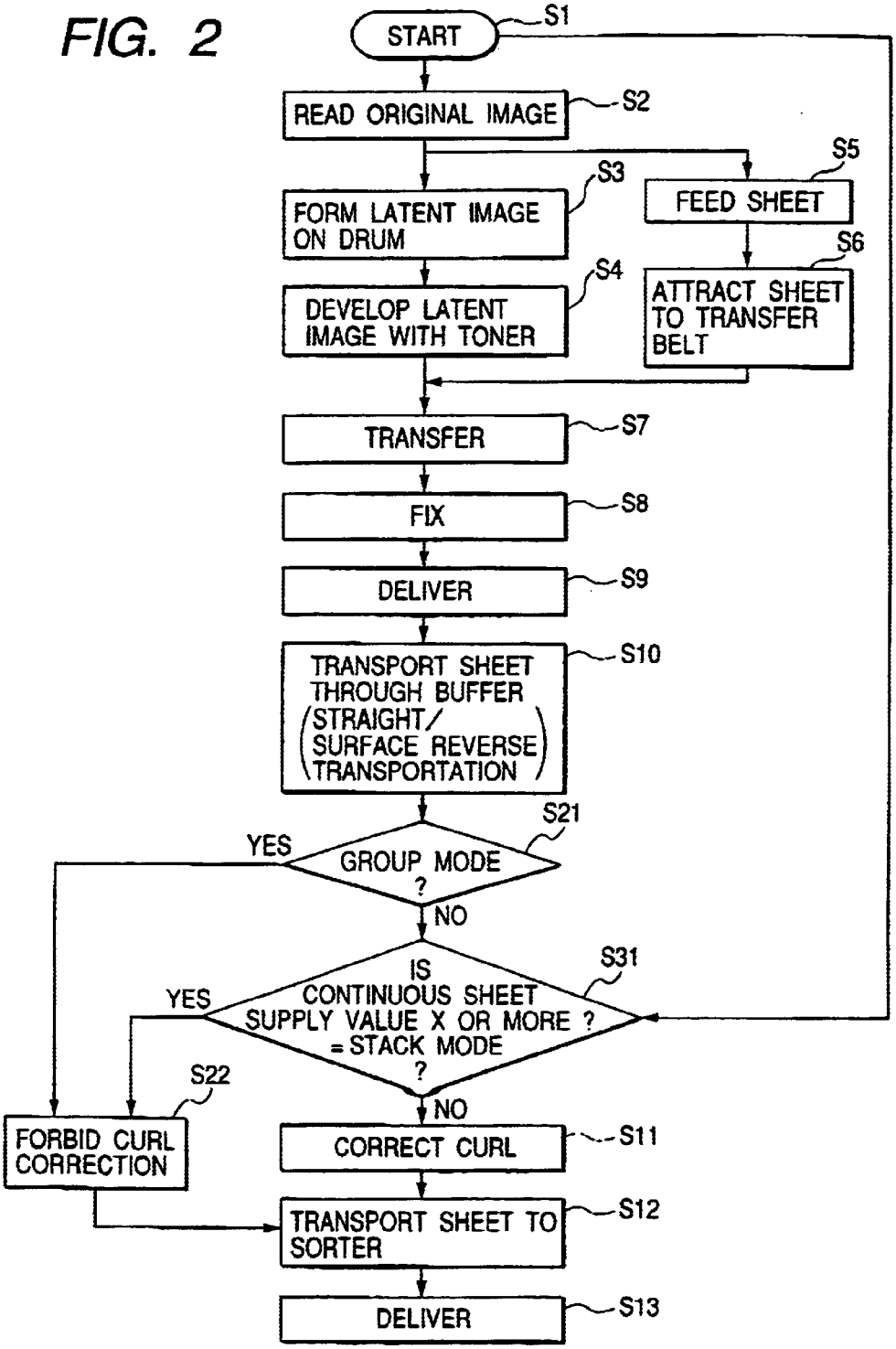
FIG. 2 is a flowchart showing a flow of the operation of an image forming apparatus according to a second embodiment of the present invention.

FIG. 2 shows a flowchart of the operation of a second embodiment of the present invention. The operation of the second embodiment includes a new step added to the steps in the control flow of the first embodiment, and only the characterized new step is described in detail.

The configuration of the second embodiment itself is the same as that of the first embodiment that has been described by reference to FIG. 3, FIG. 8A, FIG. 8B, FIG. 13 and FIG. 14. The descriptions of the configuration are consequently omitted.

FIG. 2 is a flowchart showing the flow of the operation of an image forming apparatus according to the second embodiment of the present invention. Incidentally, the steps in FIG. 2 same as those in FIG. 1 referred with regard to the first embodiment are designated by the same reference marks, and their descriptions are suitably omitted.

The present embodiment includes a piece of operation in addition to the operation of the first embodiment in the control flow thereof. In the added operation, when the number of sheets of continuous supply is a predetermined value "X" or more (or when a judgment result at Step S31 is a YES) at the time of starting (Step S1), the controlling means 301 controls the first motor 331 and the second motor 332 to inhibit their curl correction operation. When the number of sheets of continuous supply is less than the predetermined value "X"(or when a judgment result at Step S31 is a NO), the controlling means 301 controls the first motor 331 and the second motor 332 to perform their curl correction operation.

The predetermined value "X" is hereupon the maximum number of sheets stackable on the non-sort bin B0.

That is, when the number of sheets of continuous supply is designated to be a number equal to the predetermined value "X" or more and the apparatus starts to operate, because the designated number of sheets is larger than the number of sheets stackable on the non-sort bin B0, ordinarily, the sorter 200 takes its stack mode for transporting the sheets to be delivered to the sort bins B1–B20.

In the stack mode, after the sheets S have continuously been delivered to the sort bins B1–B20, the sheets S that cannot be stacked on the sort bins B1–B20 are stacked on the non-sort bin B0. Consequently, the stacking conditions of the sort bins B1–B20 in the stack mode are the same as those in the group mode.

Thus, when the sheets S are delivered to the sorter 200 in the stack mode, the stack alignment of the sheets S can be improved without any occurrence of jams of the sheets S similarly to the method described above.

Third Embodiment

Figure 4:
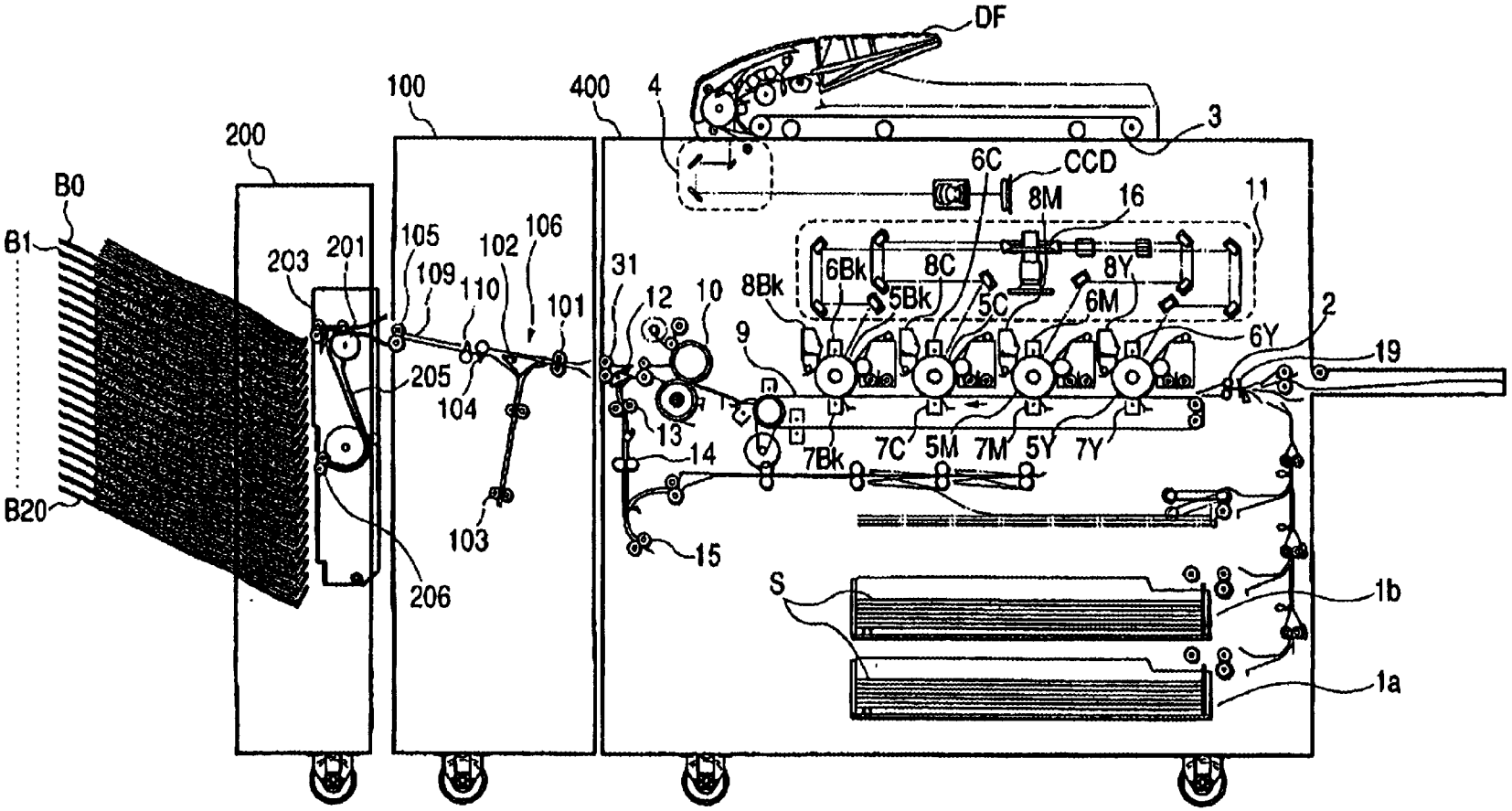
FIG. 4 is a mimetic cross section of an image forming apparatus according to a third embodiment of the present invention.
Figure 5:
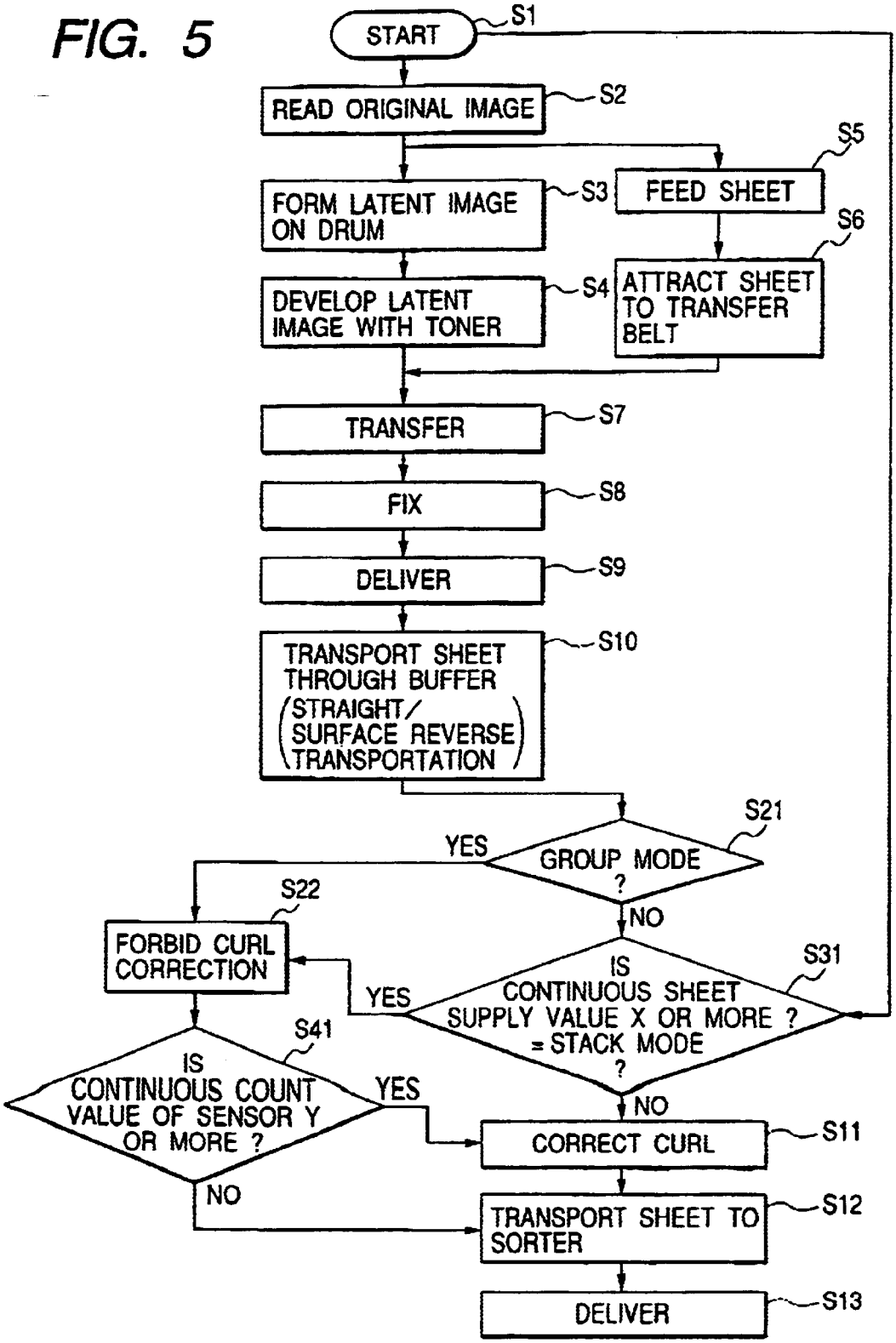
FIG. 5 is a flowchart showing a flow of the operation of the image forming apparatus according to the third embodiment of the present invention.

FIG. 4 and FIG. 5 respectively show the configuration and the operation of a third embodiment of the present invention. The operation of the third embodiment includes a new step added to the steps in the control flow of the second embodiment, and only the characterized new step is described in detail.

FIG. 4 is a mimetic cross section of an image forming apparatus according to the third embodiment of the present invention. Incidentally, the image forming apparatus itself shown in FIG. 4 is the same one shown in FIG. 14. However, the states of the delivered sheets S, which concern a featured point of the present embodiment, are clearly drawn in FIG. 4. Moreover, FIG. 5 is a flowchart showing a flow of the operation of the image forming apparatus according to the third embodiment of the present invention. Incidentally, the steps in FIG. 5 same as those in FIG. 1 and FIG. 2 referred with regard to the first embodiment and the second embodiment are designated by the same reference signs, and their descriptions are suitably omitted.

In FIG. 4, a reference numeral 19 designates a count sensor for counting the number of sheets S of supply.

The control flow of the preset embodiment differs from those of the first embodiment and the second embodiment in the following point. That is, in the control flow of the present embodiment, the curl correction is started when the count sensor 19 for counting the number of sheets S of supply has counted a predetermined value "Y" or more in its continuous counting (or when a result of judgment at Step S41 is a YES) in a state such that the curl correction is forbidden in the control flows of the first or the second embodiment.

Hereupon, the predetermined value "Y" in FIG. 5 is the number of sheets S stackable on the whole of the sort bins B1–B20 of the sorter 200. Supposing that, for example, 50 sheets in the A-4 size are stackable on one sort bin of the sorter 200, the predetermined value "Y" is 1,000. Thus, the curls of the 1,001st sheet S and the subsequent sheets S are corrected (Step S11).

That is, as described above, in such a stack mode, when the sheets S cannot fully be stacked on the sort bins B1–B20 of the sorter 200, the sheets S that cannot be stacked on the sort bins B1–B20 are stacked on the non-sort bin B0.

In such a case, when the curl corrections of the sheets S to be delivered on the sort bins B1–B20 and the sheets S to be delivered on the non-sort bin B0 are not performed, the case is fitted to the sheets S to be stacked on the sort bins B1–B20 as described above. However, because the curls of the sheets S to be stacked on the non-sort bin B0 owing to toner have grown after that, the stack alignment of the sheets S is bad.

Accordingly, in the present embodiment, the curl correction of the sheets S to be stacked on the non-sort bin B0 is performed to correct the curls of all of the sheets S to be stacked on the non-sort bin B0. Consequently, the stack alignment of the sheets S to be stacked on the non-sort bin B0 can be improved.

Hence, even if a large quantity of the sheets S are continuously delivered to the sorter 200, as shown in FIG. 4, both the sheets S stacked on the sort bins B0–B20 and the sheets S stacked on the non-sort bin B0 can hold their high stackability in good alignment.

Fourth Embodiment

Figure 6:
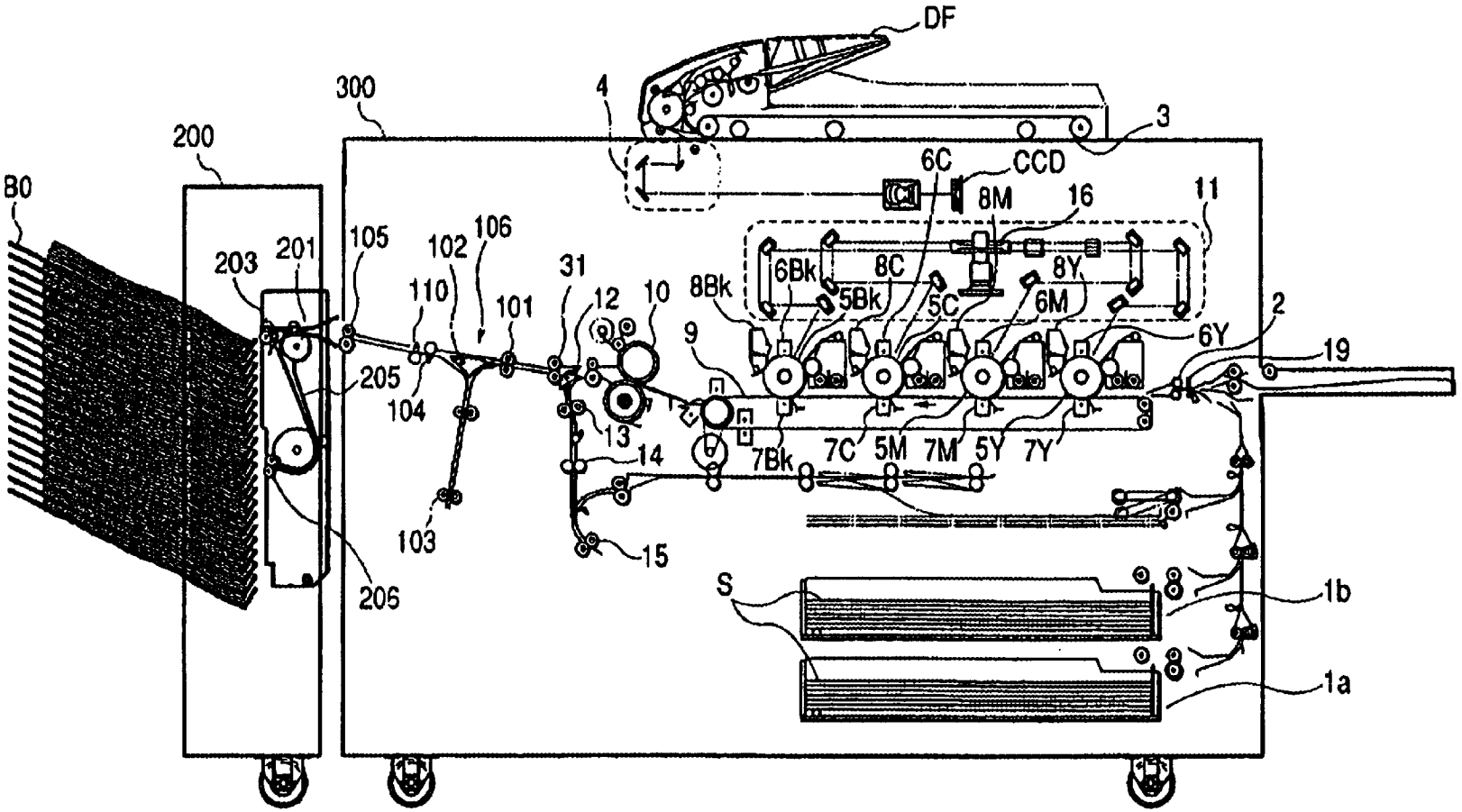
FIG. 6 is a mimetic cross section of an image forming apparatus according to a fourth embodiment of the present invention.

FIG. 6 shows a fourth embodiment of the present invention. In each embodiment described above, the main body 400 of the image forming apparatus and the sheet transporting apparatus (or the buffer unit) 100 are formed as separated apparatuses, and the image forming system is formed by the connection of the apparatuses to each other. However, in the present embodiment, these apparatuses are integrally configured to be one body.

FIG. 6 is a mimetic cross section of an image forming apparatus according to the fourth embodiment of the present invention.

As shown in FIG. 6, the configuration of the present embodiment does not differ from those of respective configurations of each embodiment described above except that the main body of the image forming apparatus 300 of the present embodiment and the buffer unit are integrally formed as one body.

Any one of the control flows of the preceding embodiments may be employed as the control flow of the present embodiment. Thereby, the advantages obtained in each embodiment described above can also be obtained in the present embodiment.

Fifth Embodiment

Figure 10:
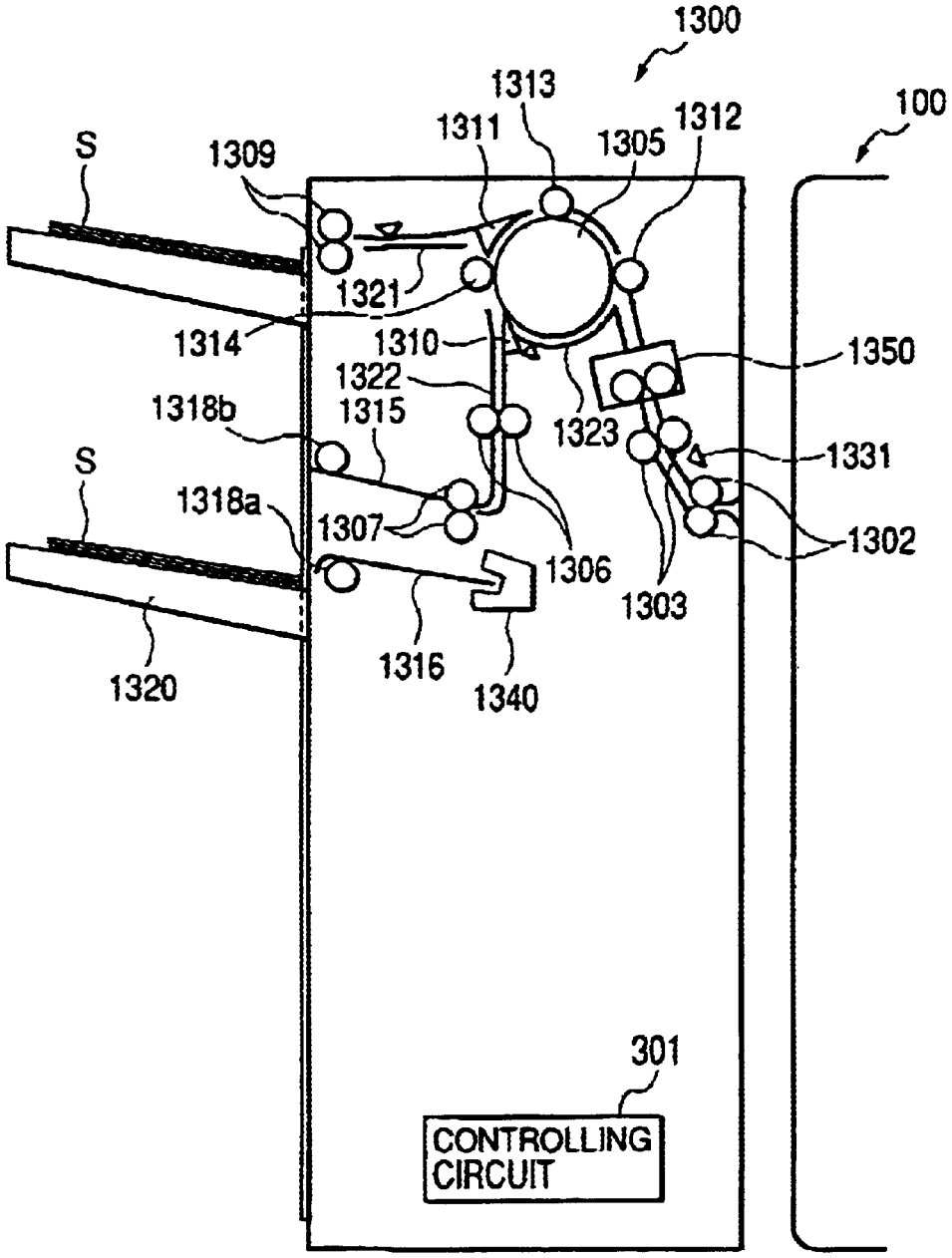
FIG. 10 is a mimetic cross section of an aftertreatment apparatus according to the fifth embodiment of the present invention.

FIG. 10 is referred while an aftertreatment apparatus 1300 according to a fifth embodiment of the present invention is described.

Whole Configuration of Aftertreatment Apparatus

In FIG. 10, the aftertreatment apparatus 1300 receives a sheet S delivered from the main body 400 of an image forming apparatus through a pair of inlet rollers 1302, and the aftertreatment apparatus 1300 transports the received sheet to the inside thereof. A pair of transportation rollers 1303 is disposed downstream of the pair of the inlet rollers 1302, and a sheet detecting sensor 1331 is disposed between the pair of the inlet rollers 1302 and the pair of the transportation rollers 1303.

A punch unit 1350 is disposed downstream of the pair of the transportation rollers 1303, and a transportation big roller 1305 and press rollers 1312, 1313 and 1314 that press the sheet S around the transportation big roller 1305 to transport the sheet S are disposed downstream of the punch unit 1350.

A switching flapper 1311 switches the transportation path of the sheet S between a non-sort path 1321 and a sort path 1322. A switching flapper 1310 disposed at an entrance of the sort path 1322 switches the transportation path of the sheet S to be transported between the sort path 1322 and a buffer path 1323 for storing the sheet S temporarily.

Transportation rollers 1306 are disposed on the midway of the sort path 1322. Temporary stacking, alignment, stapling by stapling means 1340, or the like of sheets S can be performed on an intermediate tray (hereinafter referred to as a "treating tray") 1316 as a stack tray disposed downstream of the sort path 1322.

Delivery rollers 1307 disposed at the exit of the sort path 1322 deliver the sheets S on the treating tray 1316. An upper batch delivery roller 1318*b* is supported by a swinging guide 1315. When the swinging guide 1315 moves to a closing position, the upper batch delivery roller 1318*b* cooperates with a lower batch delivery roller 1318*a* disposed at the treating tray 1316 to batch-transport the sheets S on the treating tray 1316 to batch-deliver the sheets S onto the stack tray 1320.

That is, the swinging guide 1315 inclines, and the lower batch delivery roller 1318*a* and the upper batch delivery roller 1318*b* form a pair of rollers, and thereby the sheets S on the treating tray 1316 are batch-delivered.

Figure 9:
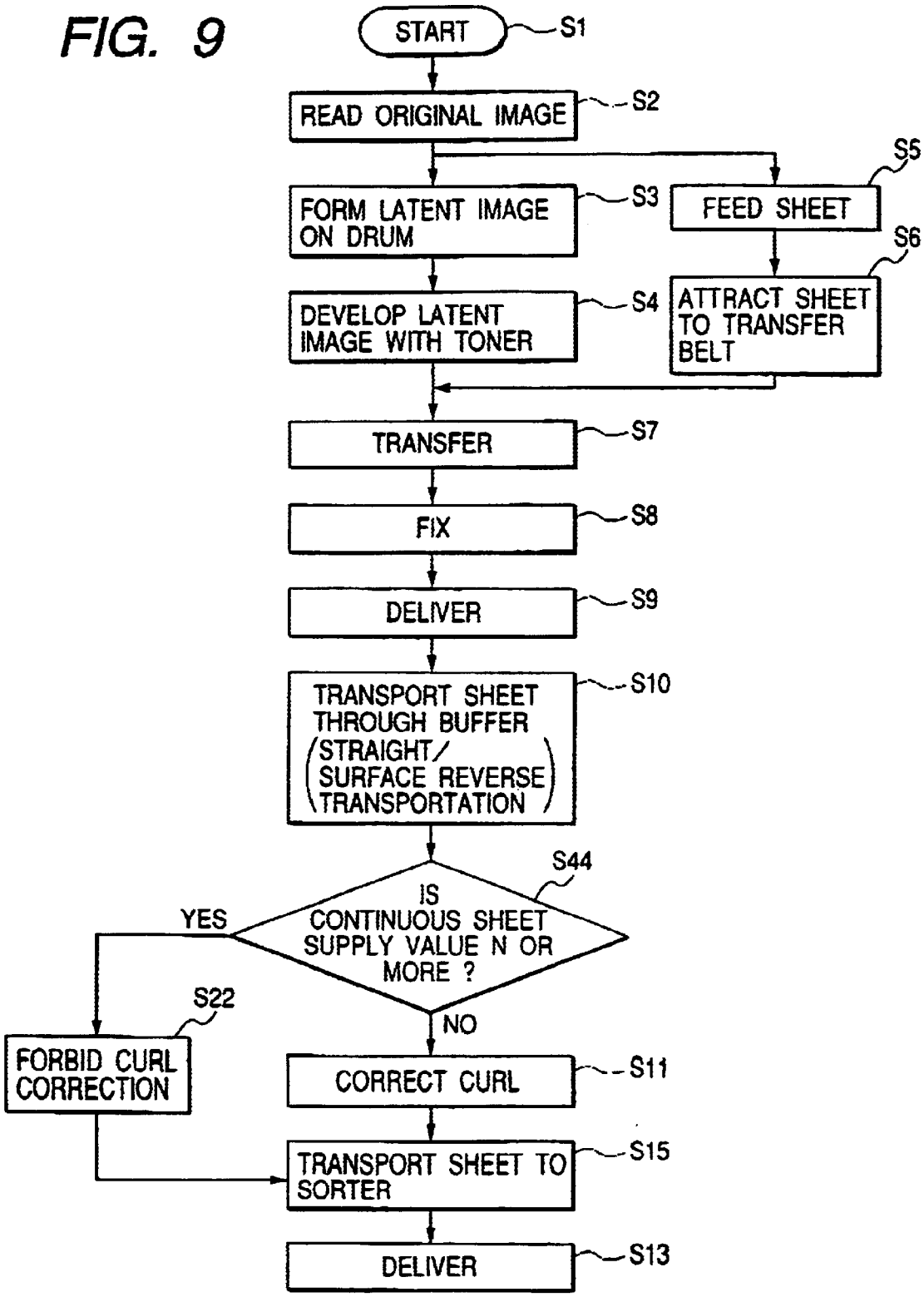
FIG. 9 is a flowchart showing a flow of the operation of an image forming apparatus according to a fifth embodiment of the present invention.

The flowchart shown in FIG. 9 is referred while the flow of the operation of each apparatus of the present embodiment is described. Incidentally, because the steps designated by the same reference signs as those in the flowchart shown in FIG. 1 of the first embodiment are the same as those of the flowchart of the first embodiment, the descriptions concerning the operation of the steps are omitted.

The flowchart of the present embodiment differs from that of the first embodiment in that the flowchart of the present embodiment includes Step S44 and Step S15.

At Step S44, when the continuous number of sheets of supply or the cumulative number of sheets of supply reaches a predetermined number "N", the curl correction operation of the buffer unit 100 is forbidden. Thereby, in the case where N or more sheets S to be stacked on the treating tray 1316 or the stack tray 1320 of the aftertreatment apparatus 1300 are continuously delivered, the curl correction operation of the sheets S is not performed. Consequently, the curls of sheets S caused by the curl correction operation of the sheets S are not formed in the sheets S. Moreover, before the growth of the curl of a previous sheet S, the next sheets S are continuously delivered. It is consequently possible to prevent a sheet jam or a falling of a sheet S from the treating tray 1316 or the stack tray 1320 owing to the curl formed in the sheets S.

Thereby, the states of sheets S to be stacked on the treating tray 1316 or the stack tray 1320 continuously can be kept to be good.

When a number of sheets S equal to the predetermined number "N" or more are continuously supplied, the execution of the control described above improves the stack alignment of the sheets S without producing any sheet jam and falling of the sheets S on the treating tray 1316 and the stack tray 1320 of the aftertreatment apparatus 1300.

Figure 11:
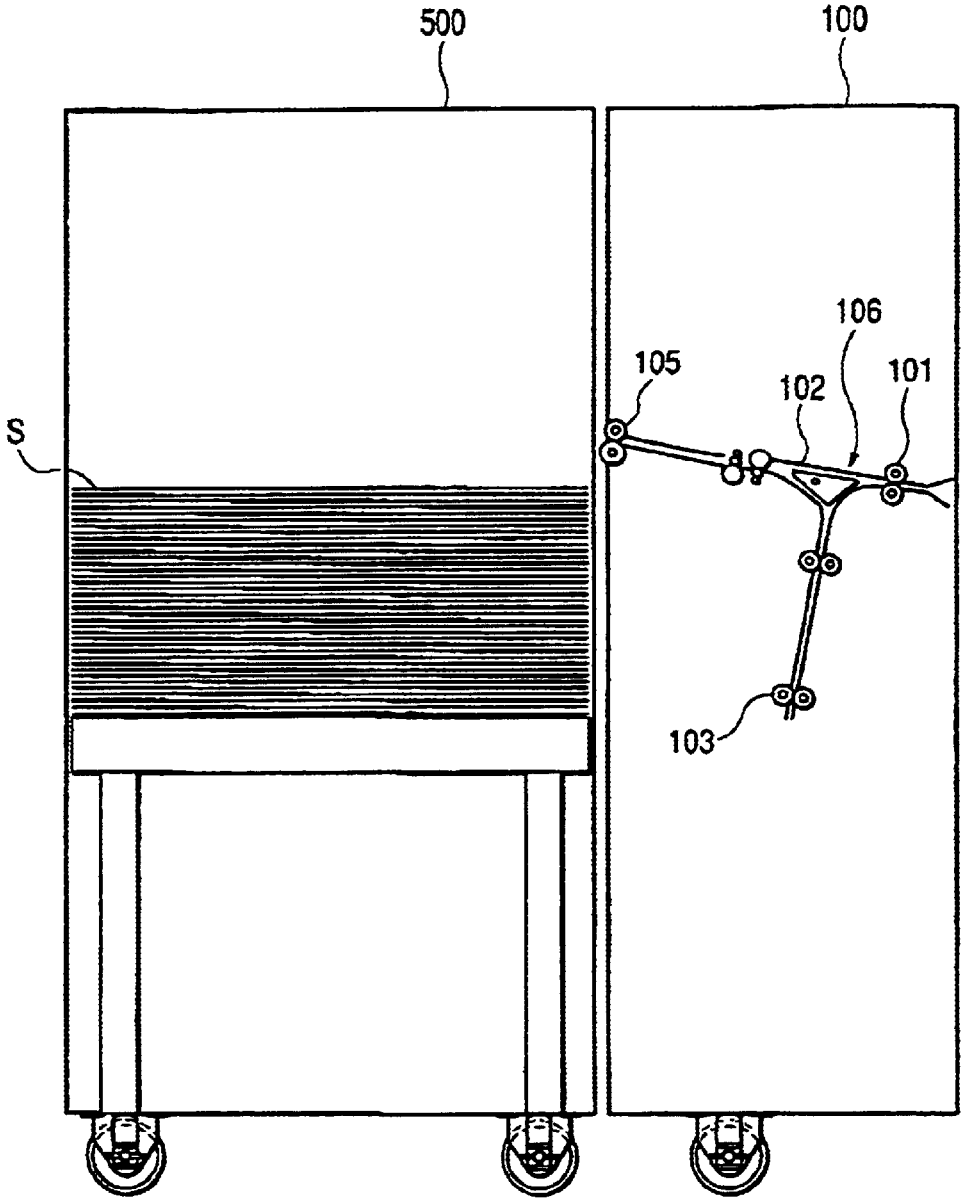
FIG. 11 is a mimetic cross section of the aftertreatment apparatus according to the fifth embodiment of the present invention.
Figure 12:
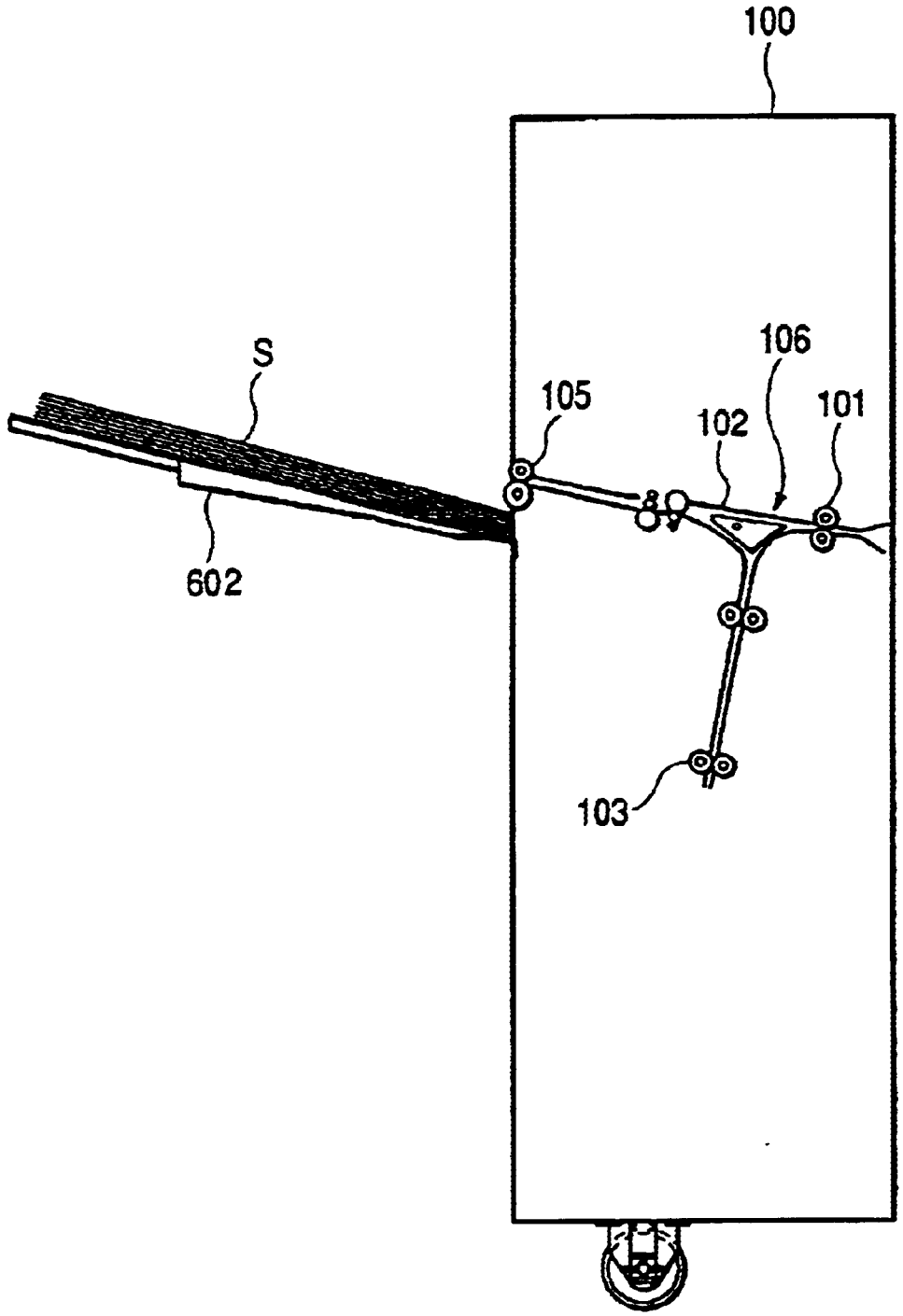
FIG. 12 is a mimetic cross section of the aftertreatment apparatus according to the fifth embodiment of the present invention.

In the case where the aftertreatment apparatus 1300 of the present embodiment is a stacker 500 capable of stacking a large quantity of the sheet S shown in FIG. 11 or a simple sheet stack tray 602 shown in FIG. 12, the similar advantages can also be obtained.

Moreover, in each embodiment mentioned above, when the correcting means of the buffer unit 100 has several steps of correcting ability (or the ability capable of changing the degree of correction), the execution of the control to lower the step of the correcting ability by one step or by several steps than the curl correcting ability according to an ordinal image density at the forbidding step of the curl correction (Step S22) brings the similar advantages.

As described above, because the present invention does not perform the correcting operation of the correcting means or performs the correcting operation while lowering the degree of correction than that in case of delivering sheets to a non-sort bin in the case where the present invention performs the continuous delivery of sheets to sort bins installed in an aftertreatment apparatus, the curls of the sheets produced by the execution of correcting operation do not formed, and the sheet jams owing to the curls can be prevented.

The feature of the present invention is preferable for the selection of the group mode or the stack mode.

What is claimed is:

1. A sheet transporting apparatus comprising:

a transporting path for guiding sheets to an aftertreatment apparatus having a function of sorting and delivering the sheets to a plurality of bins; and correcting means for correcting a curl formed in a sheet transported through said transporting path, wherein, when the aftertreatment apparatus continuously delivers the sheets to a sort bin other than a non-sort bin at an uppermost position among the plurality of bins, said correcting means does not perform a correcting operation, or said correcting means performs the correcting operation while lowering a degree of correction than that at a time of delivering the sheets to the non-sort bin.

2. A sheet transporting apparatus comprising:

a transporting path for guiding sheets to an aftertreatment apparatus having a function of sorting and delivering the sheets to a plurality of bins; and correcting means for correcting a curl formed in a sheet transported through said transporting path, wherein, when a group mode for delivering the sheets continuously to a predetermined sort bin other than a non-sort bin at an uppermost position among the plurality of bins is selected, said correcting means does not perform a correction operation, or said correcting means performs the correcting operation while lowering a degree of correction than that at a time of delivering the sheets to the non-sort bin.

3. A sheet transporting apparatus comprising:

a transporting path for guiding sheets to an aftertreatment apparatus having a function of sorting and delivering the sheets to a plurality of bins; and correcting means for correcting a curl formed in a sheet transported through said transporting path, wherein, when a stack mode for delivering the sheets to a sort bin other than a non-sort bin at an uppermost position among the plurality of bins if a number of the sheets to be delivered exceeds a number of sheets stackable on the non-sort bin is selected, said correcting means does not perform a correcting operation, or said correcting means performs the correcting operation while lowering a degree of correction than that at a time of delivering the sheets to the non-sort bin.

4. A sheet transporting apparatus according to any one of claims 1 to 3, further comprising surface reverse means for reversing front and back sides of the sheet transported from an upstream side to guide a reversed sheet to the aftertreatment apparatus.

5. An image forming apparatus comprising:

image forming means for forming an image on a transporting sheet;

a sheet transporting apparatus according to any one of claims 1 to 3 for transporting the sheet on which the image has been formed by said image forming means to a further downstream side; and an aftertreatment apparatus having a function of sorting and delivering sheets transported by said sheet transporting apparatus to a plurality of bins.

6. An image forming apparatus according to claim 5, further comprising four image forming means for forming images having different colors from each other, said four image forming means being arranged in tandem to form a full color image.

7. An image forming apparatus according to claim 5, wherein, when a number of sheets stacked on a sort bin other than a non-sort bin at an uppermost position among the plurality of bins installed in said aftertreatment apparatus reaches a maximum number of stackable sheets, or when a delivery of the sheets ceased regardless of the number of sheets stacked on the sort bin, the sheets stacked on the sort bin is clenched between the sort bin and a sort bin immediately above the sort bin.

8. A sheet transporting apparatus comprising:

a transporting path for guiding sheets to an aftertreatment apparatus that is provided with a stack tray for stacking the sheets thereon; and correcting means for correcting a curl formed in a sheet transported through said transporting path, wherein, when the aftertreatment apparatus continuously delivers the sheets to the stack tray, said correcting means does not perform a correcting operation, or said correcting means performs the correcting operation while lowering a degree of correction than that at a time of delivering the sheets intermittently.

9. A sheet transporting apparatus according to claim 8, wherein the aftertreatment apparatus has a stack function for stacking a large quantity of the sheets.

10. A sheet transporting apparatus according to claim 8, wherein the aftertreatment apparatus has a function of collating the sheets.

11. A sheet transporting apparatus comprising:

a stack tray for stacking sheets thereon;

a transporting path for guiding the sheets to said stack tray; and correcting means for correcting a curl formed in a sheet transported through said transporting path, wherein, when the sheets are continuously delivered to said stack tray, said correcting means does not perform a correcting operation, or said correcting means performs the correcting operation while lowering a degree of correction than that at a time of delivering the sheets intermittently.

12. A sheet transporting apparatus according to claim 11, wherein said stack tray is one of a plurality of bins, and wherein, when the sheets are continuously delivered to said stack tray, said correcting means does not perform the correcting operation, or said correcting means performs the correcting operation while lowering a degree of correction than that at a time of delivering sheets one by one to said plurality of bins in the order so that sheets are intermittently delivered to said stack tray.

13. A sheet transporting apparatus comprising:

a tray for stacking sheets thereon;

transporting means for transporting a sheet to said tray;

correcting means for correcting a curl formed in the sheet transported by said transporting means; and controlling means for controlling said correcting means so that, when the sheets exceeding a predetermined number are continuously transported to said tray by said transporting means, said correcting means does not perform a correcting operation, or said correcting means performs the correcting operation while lowering a degree of correction than that in a case where the sheets less than the predetermined number are continuously transported.

14. A sheet transporting apparatus according to claim 13, wherein said correcting means forms a curl opposite to a curl formed in a not-corrected sheet.

15. A sheet transporting apparatus according to claim 13, further comprising stapling means for stitching a stack of the sheets stacked on said tray.

16. An image forming apparatus comprising:

image forming means for forming an image on a sheet;

stacking means for stacking the sheet;

transporting means for transporting the sheet, on which said image forming means has formed the image, to said stacking means;

correcting means for correcting a curl of the sheet transported by said transporting means;

inputting means by which a processing instruction to said image forming apparatus is inputted; and controlling means for controlling a correcting ability of said correcting means according to the processing instruction inputted by said inputting means, wherein the processing instruction inputted by said inputting means is an instruction concerning a number of the sheets on which the images are to be formed continuously, and said controlling means controls said correcting means not to perform a correcting operation when the inputted number of the sheets is a predetermined number of the sheets or more, or to perform the correcting operation while lowering a degree of correction than that when sheets of a number less than the predetermined number are continuously delivered.

* * * * *

UNITED STATES PATENT AND TRADEMARK OFFICE

CERTIFICATE OF CORRECTION

PATENT NO. : 6,687,484 B2
DATED : February 3, 2004
INVENTOR(S) : Atsuteru Oikawa It is certified that error appears in the above-identified patent and that said Letters Patent is hereby corrected as shown below:

Drawings,
Sheet 1, Figure 1, "DEVELOPE" should read -- DEVELOP --.

Column 12,
Line 1, "B0-B20" should read -- B1-B20 --.

Column 13,
Line 47, "sheet S" should read -- (sheets S) --.
Line 66, "formed," should read -- form, --.

Signed and Sealed this

Eighth Day of June, 2004

JON W. DUDAS
*Acting Director of the United States Patent and Trademark Office*